United States Patent [19]

McFarland et al.

[11] 4,430,258

[45] Feb. 7, 1984

[54] METHOD OF PRODUCING LIQUID EQUIVALENT SOLID GAMMA RAY CALIBRATION STANDARDS

[76] Inventors: Robert C. McFarland; Patricia A. McFarland, both of 2392 Northside Pkwy., NW., Atlanta, Ga. 30327

[21] Appl. No.: 267,802

[22] Filed: May 28, 1981

[51] Int. Cl.[3] ..... G21G 4/04

[52] U.S. Cl. ..... 252/644; 252/600; 252/408.1; 436/8; 436/57; 436/58

[58] Field of Search ..... 252/408.1, 645, 600, 252/316, 644; 427/5, 6; 250/493; 436/8, 57, 58

[56] References Cited

U.S. PATENT DOCUMENTS

| | | | |
|---|---|---|---|
| 3,133,025 | 5/1964 | Walker et al. | 252/644 |
| 3,256,219 | 6/1966 | Will | 260/2.5 |
| 3,317,321 | 5/1967 | Chopoorian | 252/600 |
| 3,390,121 | 6/1968 | Burford et al. | 252/408.1 |
| 3,492,147 | 1/1970 | Young et al. | 427/5 |
| 3,629,132 | 12/1971 | Maletskos et al. | 252/645 |
| 3,723,349 | 3/1973 | Heseltine et al. | 252/408.1 |
| 4,016,099 | 3/1977 | Wellman et al. | 252/316 |
| 4,358,401 | 11/1982 | O'Brien | 252/628 |

FOREIGN PATENT DOCUMENTS

| | | | |
|---|---|---|---|
| 1303924 | 10/1961 | France | 252/645 |
| 55-119437 | 9/1980 | Japan | 252/316 |
| 929226 | 6/1963 | United Kingdom | 252/316 |
| 1187368 | 4/1970 | United Kingdom | 250/493.1 |

OTHER PUBLICATIONS

Carpenter, Robert, 1972, Polyesters, Water-Extended *Encyclopedia of Polymer Science and Technology,* vol. 15.

*Primary Examiner*—Deborah L. Kyle
*Assistant Examiner*—Howard J. Locker
*Attorney, Agent, or Firm*—William H. Needle

[57] ABSTRACT

Method of producing liquid equivalent solid gamma ray calibration standards comprising the steps of adding a first organic solvent to a calibrated aqueous solution of radioactive material, either in the form of a single isotope or mixed isotopes, to form a first solution; mixing the first solution with a polymerizible resin dissolved in a second organic solvent together with a hardening catalyst to form a second solution; and curing the second solution. With isotope standards requiring highly acidic conditions, a stabilizing agent is added to the first solvent to complex with metal and hydrogen ions so as to prevent plate-out.

14 Claims, No Drawings

METHOD OF PRODUCING LIQUID EQUIVALENT SOLID GAMMA RAY CALIBRATION STANDARDS

BACKGROUND OF THE INVENTION

1. Field of the Invention

This invention relates to the calibration of gamma spectrometer systems and, more particularly, to a method of producing liquid equivalent solid gamma ray calibration standards.

2. Discussion of the Prior Art

Gamma spectrometer systems using either NaI(Tl) or Ge(Li) detectors are used to perform qualitative and quantitative assays of liquid samples for radioactive material. Before the assays can be performed, the spectrometer system must be calibrated. This means that the relationship between gamma ray energy and analyzer channel number as well as the detector efficiency as a function of gamma ray energy must be known. These calibrations are best accomplished using standard gamma ray sources which emit gamma rays of known energy and have an accurately known gamma ray emission rate. With modern high resolution Ge(Li) gamma ray detectors, it is most economical to calibrate using mixed isotope sources which emit numerous gamma rays of different energies. The energy vs. channel number calibration is very easily performed by fitting a polynomial function to the energy vs. channel number data from a mixed source. In most systems, a linear relationship is sufficiently accurate but a quadratic or a cubic equation can be fit to the data for the most accurate calibration.

Unfortunately, the efficiency calibration of a gamma spectrometer system is more complicated than the energy calibration. The detector efficiency varies with the energy of the gamma ray and with the distance of the source to the detector. Variations of the detector efficiency with source distance produce variations in sample counting efficiency with container size and shape. Standards containing known quantities of radioactive material in each size and shape container must be measured in each counting position before quantitative analyses can be performed. Calibration standards must also be approximately the same density as the samples being analyzed to avoid the problem of correcting for differences in gamma ray scattering and absorption.

Liquid solutions of radioactive material commonly used as calibration standards suffer from several deficiencies. Liquid sources frequently leak or are spilled on radiation detectors, laboratory areas, or laboratory personnel. These types of accidents with high level radioactive material dissolved in chemically corrosive solutions can be very serious. More difficult to detect, low level-long term leakage from radioactive standard solutions has frequently contaminated radiation detection equipment to the point where it is useless in the measurement of low level radioactivity. In addition to these difficulties in the use and storage of liquid radioactive standards, disposal of expired liquid standards is also a problem. Current radioactive waste disposal regulations prevent most laboratories from directly disposing of the quantities of liquid radioactive material used as standards without large dilution tanks. Liquid radioactive waste generally must be solidified in some manner before disposal.

Aside from the question of safety, the preparation and storage of liquid radioactive standards is complicated by the solution chemistry of the elements involved. Mixtures containing widely different chemical species are particularly troublesome. Selective plate-out, precipitation, or volatilization can destroy the homogeneity of a liquid standard and render it useless for calibration purposes. The seven element mixture consisting of Cd, Co, Ce, Hg, Sn, Cs and Y commonly used in gamma ray calibration standards is plagued by problems of this kind. If the solution is weaker than 4 N in HCl, the Sn-113 will precipitate. Maintaining this high acidity for a long period of time in relatively porous plastic containers has been difficult. Also, certain types of plastic have been found to selectively remove tin from these standard solutions. Plate-out frequently occurs on glass surfaces where Y, Ce, and Cs are ion exchanged onto glass container surface, thus destroying the standard. Deposits of dirt or chemical residues from laboratory air can cause selective precipitation of some of the elements in a mixed standard. Consideration of these problems with liquid radioactive standards has led to the development of liquid equivalent solid radioactive sources with the radioactive material uniformly dispersed in a low density solid whose gamma ray attenuation properties closely match those of water.

Previous Solid Standards

Various approaches to the production of solid gamma ray calibration standards have been attempted in the past few years. Processes for solidification of radioactive waste such as the vinyl ester method of Dow Chemical Company or the urea-formaldehyde process of Chem Nuclear Systems, Inc. proved to be unsatisfactory for standard production. The density and homogeneity of solid radioactive sources produced by these methods are not acceptable for calibration standards. Various gelation agents have also been tested and discarded due to instability in the semi-solid products. Progress toward more satisfactory solid standards has been made with emulsified resin mixtures, solvent extraction systems, and water miscible resins.

Solid calibration standards have been prepared using resin-water emulsions. Ashland Chemical Company's water extendible polyester (U.S. Pat. No. 3,256,219) is an example of this type of material. To produce solid gamma ray calibration standards using the emulsion technique, an aqueous solution of radioactive material is mixed with an equal weight of polyester resin to form an emulsion which is solidified by adding a catalyst. This process has several deficiencies when applied to the production of gamma ray calibration standards. Uniformity on the fine scale necessary for calibration standards is difficult to obtain using emulsions. The very high speed mixing necessary to produce an emulsion requires that the material be mixed in something other than the final standard container, thereby greatly increasing the volume of radioactive waste generated in the production of customized radioactive standards. Since the radioactive material in an emulsion is generally in the small droplets of aqueous solution, the same plate-out and precipitation processes which plague liquid solution standards cause problems in emulsion systems during mixing. In general, plate-out problems are greater in the emulsion system because the acidity of the aqueous solutions must be kept at a low level or the hardening catalyst will be destroyed. Mixed calibration standards which require Sn-113 are very difficult to produce by the emulsion method due to the high acidity required to stabilize tin in aqueous solution and the high affinity of tin for various container materials.

The high percentage of water required to produce a stable, uniform emulsion introduces additional constraints on calibration standards produced from emulsions. Ashland describes these emulsion-produced solids as "water-filled foams," and states that these solids lose water by evaporation over a long period of time. Data published by Ashland Chemical Company shows the water loss to be 0.51% in three days and over 9% in one year. This protracted loss of weight means that the gamma ray attentutation properties of the material are continuously changing over the life of standards produced from it. Furthermore, the water loss rate is not predictable and may be considerately greater than the above values depending on the size, shape, and outside container of the standard. Due to the presence of many small pockets of water, emulsion type solids may suffer cracking problems when shipped in cold weather or when stored in unheated storage areas. In order to escape the difficulties caused by the presence of free water in emulsion produced solids, solvent extraction systems were investigated.

Numerous complexing agents have been developed which are capable of extracting various metal ions from aqueous solutions and stabilizing these ions in water immiscible solvents. Complexing agents can be used to extract certain radioactive metal ions from aqeuous solutions into resin solutions where they may be solidified. Single element solid standards produced by the solvent extraction method show excellent uniformity in the final product when the correct conditions for extraction are achieved. Solids of this type do not contain significant quantities of water and are free from the previously discussed problems of water containing systems. Unfortunately, changing from an aqueous system to a non-aqueous solvent system complicates the solution chemistry. Quantitative extraction of metal ions is rarely observed and the conditions of metal ion concentration and acidity must be strictly controlled. Uncertainty in the actual amount of metal ion extracted is a very serious problem in these types of standards. Additional radioactivity assays must be performed after the extraction on either the aqueous phase or the less stable non-aqueous solution. Either of these procedures introduces additional uncertainty into the calibration on the final standards. These extraction problems become much more severe when the production of standards containing a mixture of elements is considered. The optimum conditions for extraction vary widely from element to element and limit the number of different elements that can be incorporated into the same resin solution. For these reasons, extraction standards using the eight element mixture previously discussed have been very difficult to produce and the accuracy of the final product has been poor.

Another approach to the production of solid gamma ray calibration standards uses a water miscible resin to dissolve and solidify the radioactive aqueous solution. This process is better suited to the production of custom made standards than is the emulsion process due to the fact that only gentle stirring is necessary to mix the components. Some standards produced using water miscible resins have been found to be of sufficient uniformity for calibration standards. Having not been designed for calibration standard production, commercially available water miscible resin systems cannot tolerate the high acidity necessary to stabilize aqueous radioactive solutions. High acidity prevents the resin from mixing with the aqueous solution and also destroys the catalyst. If the acidity of the aqueous solution is decreased to accomodate the resin, plate-out of radioactive material occurs before solidification.

Plate-out problems limit the type of containers that can be used with the water miscible resin systems. Soft polyethylene and cellulose plastic containers cannot be used due to selective plate-out of some of the components of mixed standards solutions. Containers which have acquired a film of basic residue while sitting in the laboratory cause plate-out of Ce, Y and Cs from standard solutions. Soft glass containers also show a tendency to ion exchange Ce, Y, and Cs onto their surfaces. These plate-out problems greatly increase the cost of preparing standards using the water miscible resin system by causing more standards to be rejected, using more materials, and increasing the quantity of radioactive waste.

SUMMARY OF THE INVENTION

The above disadvantages of the prior art are overcome by the present invention which is directed to a new approach to the solidification of aqueous radioactive solutions by employing a first solvent which allows an aqueous solution of radioactive material to form a homogenous solution with a water immiscible resin dissolved in a second solvent. The process of the present invention is utilized for either mixed or single isotopes requiring either highly or moderately acidic conditions or requiring basic conditions. With highly acidic solutions of radioactive material, a stabilizing agent is present in the first solvent to complex with metal and hydrogen ions, preventing plate-out. The process requires only a gentle mixing of the ingredients and is generally performed in the final standard container. The resultant solution is normally allowed to sit until cured.

The currently preferred components include the first solvent being any alcohol with less than 5 carbon atoms, and preferably being butanol; the stabilizing agent being triisooctylamine (TIOA); the second solvent being styrene; the resin being an unsaturated polyester resin derived from ethylene glycol, maleic anhydride and fumaric acid and the catalyst being methyl ethyl ketone peroxide.

The present invention has been utilized to produce solid standards comprising mixed isotope sources such as Cd-109, Co-57, Ce-139, Hg-203, Sn-113, Cs-137, Y-88 and Co-60; Ce-139, Sn-113, Cs-137 and Co-60; Ba-133, Cs-137 and Co-60; Ba-133, Cs-137, Mn-54 and Co-60; Cd-109, Eu-152 and Co-60; and Eu-154, Eu-155 and Sb-125; and single isotopes such as Sn-113, Eu-152, Eu-154, Eu-155, Cd-109, Co-57, Co-58, Co-60, Ce-144, Ce-139, Y-88, Cs-134, Cs-137, Cr-51, Fe-59, Zn-65, Mn-54, Ba-133, Sb-125, Hg-203, Na-22, Sr-85, I-125, I-129, T-131 and Cr-51.

DETAILED DESCRIPTION OF THE INVENTION

This invention is a process for producing liquid equivalent solid gamma ray calibration standards utilizing a monomer, first solvent which is capable of dissolving an aqueous solution of radioactive material, keeping the aqueous solution dissolved while forming a homogenous solution with a polymerizible resin dissolved in a second monomer solvent and reacting with the resin and second solvent under the influence of a catalyst to produce a polymeric, homogenous solid containing the original radioactive material. The first solvent can contain a stabilizing agent to complex with metal and hydrogen ions to prevent plate-out and allow highly acidic solutions to be solidified. The currently preferred use of this invention employs n-butanol as the first solvent; triisooctylamine (TIOA) as the stabilizing agent; styrene as the second solvent; an unsaturated polyester resin derived from ethylene glycol, maleic anhydride, and fumaric acid as the polymerizible resin, preferably USS Polyesters' MR11048 casting resin; and methyl ethyl ketone peroxide as the catalyst.

The first solvent can be any alcohol with less than five carbon atoms. Experiments have been conducted with a series of alcohols including n-amyl alcohol, isoamyl alcohol, and all alcohols with less than five carbon atoms. The first experiments were conducted without radioactive material to determine the ability of each alcohol to mix with an acidic aqueous carrier solution and to form a homogeneous solid with polyester resin. From the first tests, it was concluded that alcohols of less than five carbon atoms could be used to solidify aqueous carrier solution. A second series of experiments with radioactive material was conducted using the mixed gamma standard solution of the present invention which confirmed that alcohols with less than five carbon atoms could be used in the process to produce solid radioactive standards.

The following are examples of various solid calibration standards produced in accordance with the present invention:

EXAMPLE 1

Mixed Gamma Ray Standards Requiring Highly Acidic Conditions

This process begins with a calibrated aqueous solution containing Cd-109, Co-57, Ce-139, Hg-203, Sn-113, Cs-137, Y-88, and Co-60 or a mixture of only Ce-139, Sn-113, Cs-137, and Co-60 together with about 10 to 200 parts per million of each stable element in 4 N HCl. One volume of the aqueous solution is added to 10 volumes of a first solvent, n-butanol, containing about 2.5% TIOA by volume and stirred until a clear, first solution is obtained. To this first solution, 100 volumes of 50% resin by volume in styrene, the second solvent is added and the mixture is stirred until a clear, second solution is again obtained. The order of addition of reagents is essential or the aqueous solution will not mix with the resin to form a clear solution. An appropriate amount of hardening catalyst (methyl ethyl ketone peroxide) is added and mixed with the second solution. The second solution is allowed to sit until cured, which generally takes about 24 hours. Cooling may be necessary during curing depending on the shape of the standard being cast.

In the above example, the strength of the HCl can range from 3–4 N. The ratio of aqueous solution to first solvent (1:10) is the maximum that can be used for 4 N HCl solutions. Any lower ratio can be used if desired. After addition of the mixed radionuclide solution to the first solvent, water may be added as long as the ratio of aqueous solution to first solvent does not exceed 1 to 10. The amount of resin solution can be cut up to 50%, but the mechanical strength of the final product will be decreased. The amount of the resin to second solvent can range from 40–60%; if the strength is below 40%, the resin usually doesn't polymerize. The TIOA stabilizing agent is necessary in this example to complex with the hydrogen ions in the highly acidic solution and to allow it to mix with the co-solvent. The concentration of TIOA can vary from 1% up to 10% by volume without adverse effects.

The exact amount of hardening catalyst required depends on the acidity of the aqueous phase, the ratio of first solvent to resin solution, and the size and shape of the standard being cast. The quantity of catalyst is generally determined by tests on nonradioactive solutions prior to making standards. The range of concentration of catalyst runs from 0.3% for 4 liter Marinelli beaker standards to 5% for 20 ml scintillation vials. The large, complicated shaped containers generally require cooling during curing to prevent internal cracking. Room temperatures should be maintained between 60° F. and 90° F. for best results.

EXAMPLE 2

Sn-113 Single Isotope Standards Requiring Highly Acidic Conditions

Following the procedure outlined in Example 1, single isotope standards of Sn-113 can be produced. An aqueous solution (4 N HCl) consisting of a calibrated quantity of Sn-113 with 10 to 200 parts per million stable tin can be solidified using the materials and proportions given above. TIOA stabilizing agent is necessary to complex with the hydrogen ions in this system, also.

EXAMPLE 3

Long-Lived Mixed Gamma-Ray Calibration Standards Requiring Moderate Acidity

Four different mixtures of long lived radioisotopes can be used with moderately acid solutions of 0.1 N HCl to 1.0 N HCl. These mixtures are (1) Ba-133, Cs-137, and Co-60; (2) Ba-133, Cs-137, Mn-54, and Co-60; (3) Cd-109, Eu-152, and Co-60; and (4) Eu-154, Eu-155, and Sb-125. The procedure of Example 1 can still be used to solidify these solutions; however, the concentration of TIOA and of hardening catalyst may be reduced due to the lower acidity. TIOA concentration may vary from 0.1% to 10% by volume for these mixtures. The amount of catalyst needed is generally lower than the amount required for highly acid solutions, but it is best to determine the exact amount by experimentation with similar non-radioactive solutions.

EXAMPLE 4

Single Isotope Standards Requiring Moderately Acid Conditions

Most of the radionuclides of interest in calibration standards fall into this category. Solutions of the following radioisotopes may be solidified using the procedure outlined in Example 3: Eu-152, Eu-154, Eu-155, Cd-109, Co-57, Co-58, Co-60, Ce-144, Ce-139, Y-88, Cs-134, Cs-137, Cr-51, Fe-59, Zn-65, Mn-54, Ba-133, Sb-125, Hg-203, Na-22, and Sr-85. Generally, carrier or stable element concentrations are kept below 100 parts per million but higher concentrations do not interfere, except in the case of manganese. Manganese concentrations of 500 ppm and above interfere with the polymerization process.

EXAMPLE 5

Single Isotope Standards Requiring Reducing Conditions in a Basic Medium

Isotopes of iodine require reducing conditions in basic aqueous solutions to prevent the formation and loss of volatile iodine compounds. Solutions of I-125, I-129 or I-131 are kept in NaOH or KOH solutions with a sulfite reducing agent. In these solutions, the hydroxide ion concentration varies from 0.01 N to 0.2 N and the sulfite reducing agent concentration is of the order of 10 to 100 parts per million. Stable iodine is generally added to I-125 and I-131 solutions in concentrations between 1 and 100 parts per million. These iodine solutions may be solidified using the procedure outlined in Example 1. When working with basic solutions, the TIOA stabilizing agent is not required. However, TIOA does not interfere with the process and may be used without any adverse effects. The presence of a small amount of reducing agent does not interfere with the solidification process.

EXAMLE 6

Single Isotope Standards Requiring Basic Conditions

Standards may be prepared using Cr-51 as the chromate in a weakly basic solution. The general procedure outlined in Example 1 is used to solidify Cr-51 solutions when the chromate concentration is less than 200 parts per million and the hydroxide concentration is less than 0.2 normal. TIOA is generally used when solidifying these solutions, but it is not necessary.

There are several advantages to the solid standards prepared by the present invention. For instance, custom made solid radioactive calibration standards can be prepared in any of the common counting containers in use in the nuclear industry. Also, the number of standards rejected due to plate-out or precipitation has been reduced to a negligible level, well below 10% of the number rejected when using other processes.

The process requires only gentle stirring with a hand held rod or a laboratory mixer. Standards can be mixed in the final container without loss of material, thereby eliminating additional weighing errors and reducing the volume of radioactive waste generated in the production process.

Glass stirring rods can be used instead of the expensive Teflon-coated metal rods required for high speed mixing in the emulsion process. Using glass stirrers is also advantageous, because Teflon-coated metal stirrers frequently experience plate-out of radioactive material on metal surfaces exposed by abrasion.

The solid standards of the present invention have the high degree of homogeneity required for calibration standards. After curing, the physical dimensions are constant and the gamma ray attentuation properties show no variation with time. Also, the solid standard material of the present invention is not subject to the freeze-thaw damage of emulsion solids, thereby making winter shipment possible. Further, the solidification process of the present invention incorporates all of the initial aqueous solutions in the final solid. In contrast with the prior art extraction process, there is no aqueous phase remaining and no additional radioactivity assays are required.

Finally, the present solidification process has been able to produce homogenous solid standards using a wide variety of radioactive elements. Mixed standards using the eight element mixture of Cd, Co, Ce, Hg, Sn, Cs, and Y are easily produced with no plate-out or precipitation problems. Standards using radioactive iodine have been prepared with no volatilization loss of iodine and have exhibited an exceptional stability which far exceeds other forms of radioactive iodine standards.

We claim:

1. A method of producing solid gamma ray calibration standards, comprising the steps of:

(a) preparing a calibrated aqueous solution of radioactive material;

(b) adding a first volume of said calibrated aqueous solution of radioactive material to a second volume of a first solvent comprising an alcohol having less than 5 carbon atoms to form a first solution, and wherein said first volume is less than said second volume;

(c) dissolving an unsaturated polyester resin in styrene;

(d) mixing said resin dissolved in styrene with said first solution to form a mixture;

(e) adding a hardening catalyst to said mixture;

(f) stirring said mixture until a clear second solution is produced; and (g) curing said second solution for a selected period of time.

2. A method as claimed in claim 1 wherein said calibrated aqueous solution is acidic, ranging in strength from 0.1 N HCl to 4 N HCl.

3. A method as claimed in claim 2 wherein said first solvent further includes a stabilizing agent to complex metal and hydrogen ions in said calibrated aqueous solution so as to prevent plate-out and allow said calibrated aqueous solution to be solidified.

4. A method as claimed in claim 3 wherein said stabilizing agent is triisooctylamine.

5. A method as claimed in claim 2 wherein the maximum ratio of said first volume to said second volume is 1:10 when said calibrated aqueous solution has a strength of 4 N.

6. A method as claimed in claim 4 wherein the concentration of said triisooctylamine ranges from 0.01% to 10% by volume.

7. A method as claimed in claim 1 wherein the first solvent is n-butanol.

8. A method as claimed in claim 1 wherein said calibrated aqueous solution of radioactive material contains a selected amount of stable element corresponding to each radioactive element in said solution.

9. A method as claimed in claim 2 wherein said radioactive material comprises mixed radionuclides selected from the group consisting of Cd-109, Co-57, Ce-139, Hg-203, Sn-113, Cs-137, Y-88 and Co-60; Ce-139, Sn-113, Cs-137 and Co-60; Ba-133, Cs-137 and Co-60; Ba-133, Cs-137, Mn-54 and Co-60; Cd-109, Eu-152 and Co-60; and Eu-154, Eu-155 and Sb-125.

10. A method as claimed in claim 2 wherein said radioactive material comprises a single isotope selected from the group consisting of Sn-113, Eu-152, Eu-154, Eu-155, Cd-109, Co-57, Co-58, Co-60, Ce-144, Ce-139, Y-88, Cs-134, Cs-137, Cr-51, Fe-59, Zn-65, Mn-54, Ba-133, Sb-125, Hg-203, Na-22 and Sr-85.

11. A method as claimed in claim 1 wherein said calibrated aqueous solution is basic with an hydroxide concentration ranging from 0.01 N to 0.2 N and wherein said calibrated aqueous solution further includes a sulfite reducing agent in a concentration ranging from 1 to 100 parts per million.

12. A method as claimed in claim 11 wherein said radioactive material comprises a single isotope selected from the group consisting of I-125, I-129, I-131 and Cr-51.

13. A method as claimed in claim 1 wherein said hardening catalyst is methyl ethyl ketone peroxide.

14. A solid gamma ray calibration standard produced in accordance with the method of claim 1.

* * * * *